United States Patent [19]

Heel

[11] Patent Number: 5,014,371

[45] Date of Patent: May 14, 1991

[54] PORTABLE SALON UNIT

[75] Inventor: Jurgen D. Heel, Alexandria, Va.

[73] Assignee: Salon Care Services, Inc., Sterling, Va.

[21] Appl. No.: 398,384

[22] Filed: Aug. 24, 1989

[51] Int. Cl.[5] ..... A45D 19/04

[52] U.S. Cl. ..... 4/516; 4/519; 4/518; 4/644; 4/645

[58] Field of Search ..... 4/515, 516, 517, 518, 4/519, 520, 521, 522, 523, 638, 643, 644, 645, 646, 258, 262, 263, 264, 265; 134/115 R, 198; 433/97

[56] References Cited

U.S. PATENT DOCUMENTS

| | | | |
|---|---|---|---|
| Re. 28,405 | 5/1975 | Sollerud | 4/516 |
| 1,244,535 | 10/1917 | Nutter | 4/519 |
| 1,802,890 | 4/1931 | Fritsch | 4/644 |
| 1,855,864 | 4/1932 | Mjaaland et al. | 4/644 |
| 1,896,933 | 2/1933 | Anastasi | 4/517 |
| 2,498,736 | 2/1950 | Freund | 4/644 |
| 2,682,058 | 6/1954 | Wolfe | 4/516 |
| 2,760,207 | 8/1956 | Glintz | 4/516 |
| 2,850,742 | 9/1958 | Glintz | 4/516 |
| 3,013,280 | 12/1961 | Coffman et al. | 4/516 |
| 3,192,537 | 7/1965 | Coffman et al. | 4/516 |
| 3,206,770 | 9/1965 | Carlson | 4/644 X |
| 3,226,733 | 1/1966 | Ashton | 433/97 |
| 3,523,306 | 8/1970 | Sabella | 4/518 |
| 3,653,078 | 4/1972 | Buchtel et al. | 4/263 |
| 3,694,826 | 10/1972 | Pugh | 4/516 |
| 4,081,867 | 4/1978 | Simeola | 4/516 |
| 4,307,475 | 12/1981 | Schmidt | 4/264 |
| 4,425,672 | 1/1984 | Johnson et al. | 4/596 |
| 4,660,233 | 4/1987 | Beaver | 4/516 |
| 4,821,347 | 4/1989 | Nash | 4/516 |

FOREIGN PATENT DOCUMENTS

| | | | |
|---|---|---|---|
| 569966 | 4/1924 | France | 4/516 |
| 1309939 | 10/1962 | France | 4/516 |
| 402898 | 12/1933 | United Kingdom | 4/516 |

*Primary Examiner*—Henry J. Recla
*Assistant Examiner*—Glenn T. Barrett
*Attorney, Agent, or Firm*—Breiner & Breiner

[57] ABSTRACT

A portable salon unit includes a movable cart with a wash basin adjustably attached thereto. The wash basin is adjustable vertically with respect to the cart, horizontally with respect to the cart, rotatably about a vertical axis adjacent the cart, about a horizontal axis to the basin and a vertical axis to the basin. A device for supplying clean water to an object located in the basin includes a water connector at one end and a spray end at the other. A flexible supply hose is provided on a supply reel to allow the water connector to be located some distance from the cart. A water return device also including a flexible hose allows water from the basin to be returned to the source. Electricity is also supplied to the cart by use of a suitable cord on a reel.

21 Claims, 2 Drawing Sheets

PORTABLE SALON UNIT

FIELD OF THE INVENTION.

The present invention relates to an apparatus useful for salon services, and more particularly to a portable salon unit with which shampoo and other related services can be provided to patients confined to hospitals, nursing homes, and residences for the elderly or the like.

BACKGROUND OF THE INVENTION

Portable or mobile shampoo or salon devices have been disclosed in the prior art. For example, in U.S. Pat. No. 4,660,233 (Beaver), a self-contained portable apparatus is provided. The apparatus includes a wheeled cabinet which houses clean and waste water tanks as well as heating and pressuring means for the clean water. Head and foot basins are connected with the waste water tank and are pivotally mounted on lining arms which permit these tanks to fold into a nonuse position overlying each other above the cabinet and in extended position overlying a bed when in use. The support means for the basins are vertically adjustable to accommodate different bed heights.

Another portable device of the prior art is disclosed in U.S. Pat. No. 3,013,280 (Coffman, et al.). This device is mounted on wheels and includes a vertically adjustable sink provided at one side of the device. A fill tank and drain tank as well as suitable pump means are also provided. Another apparatus showing a floor mounted sink which is adjustable outwardly and downwardly from a wall is disclosed in U.S. Pat. No. 1,855,864 (Mjaaland).

Various other devices have also been disclosed in the prior art. In U.S. Pat. No. 1,244,535 (Nutter), a shampooing stand provided on wheels includes an adjustable head support. In U.S. Pat. No. 2,760,207 (Glintz), a portable shampoo cabinet with vertically adjustable legs is disclosed. A portable shampoo cabinet with a basin which can be removed from the cabinet and which includes a shower head holder is disclosed in U.S. Pat. No. 2,850,742 (Glintz). Other patents of general interest also include U.S. Pat. No. 3,523,306 (Sabella), U.S. Pat. No. 1,896,933 (Anastasi), U.S. Pat. No. 3,192,537 (Coffman, et al.).

SUMMARY OF THE INVENTION

In accordance with the present invention, a portable salon unit comprises a movable cart having pneumatic wheels attached thereto to provide mobility. A wash basin is located adjacent one side of the cart and a mounting means is provided for adjustably mounting the basin to the cart so that the basin is adjustable vertically with respect to the cart, horizontally with respect to the side of the cart, and rotatably about a vertical axis adjacent the side of the cart. A tankless water supply means supplies clean water to an object such as a user's hair located in the basin. The water supply means includes a first flexible supply hose, a water connection means for connecting an end of the first supply hose to a pressurized water outlet, a spray head, a second flexible supply hose which is connected to the spray head, and a supply reel means provided in the cart for mounting the first supply hose for winding and unwinding thereabout and for fluidly connecting the first supply hose to the second supply hose.

A tankless water return means is further provided for returning water from the basin to a drain. This water return means includes a pump means located in the cart, a first flexible return hose connected between the basin and pump means, a second flexible return hose, and a return reel means provided in the cart for mounting the second return hose for winding and unwinding thereabout and for fluidly connecting the pump means with the second return hose. Finally, an electrical means is provided for supplying electrical power to the cart. This electrical supply means includes an electrical cord having a male plug at a distal end thereof, an electrical outlet mounted in the cart having a connection wire, an electrical cord reel means provided in the cart for mounting the electrical cord for winding and unwinding thereabout and for electrically connecting the electrical cord to the connection wire.

In a preferred embodiment, the mounting means also includes means for adjustably mounting the basin for adjustment about a horizontal axis through the basin as well as a vertical axis through the basin. Further, a headrest is provided on the basin.

In the preferred embodiment, the mounting means includes an upwardly extending brace means for vertically supporting the basin, with the basin provided at a distal end thereof. This upwardly extending brace means is pivotally attached at a proximal end thereof adjacent to the bottom of the cart at the one side of the cart for rotation about a horizontal axis. The upwardly extending brace means includes a first brace, a second brace telescopically received in the first brace, and a first locking means for releasably locking the second brace relative to the first brace at selected positions. A downwardly extending brace means is also provided for holding the upwardly extending brace means at a desired inclination from the one side of the cart. The downwardly extending brace means is pivotally attached to the cart at a proximal end thereof adjacent to the top of the cart for rotation about a horizontal axis. A second locking means then releasably locks a portion of one of the first brace means and second brace means along a length of the other of the first brace means and second brace means. With this construction, the height of the basin and the horizontal distance of the basin from the cart are readily adjustable.

The mounting means also preferably includes a rod which is disposed vertically adjacent to one side which has a perpendicular handle portion and a free end depending from the handle portion. A guide means mounts this rod for vertical movement adjacent the one side with the handle portion uppermost. A plate having a rounded side extends horizontally from adjacent the top of the cart. This plate includes a series of holes spaced adjacent to the rounded side and an aperture through which the rod extends. A retainer bar is mounted below this plate. The retainer bar includes a mounting aperture through which the rod extends to rotatably mount the retainer bar thereabout and an extension which wraps around the rounded side of the plate to hold the retainer bar adjacent the plate. A locking aperture extends through the extension and an underlying portion of the retainer bar. This locking aperture selectively aligns with the holes of the plate so that the free end of the rod is extendable to lock the retainer bar relative to the plate at a selected angular position about the rod. The upwardly extending brace means is pivotally attached about the rod and the downwardly extending brace means is attached to the retainer bar which is pivotally attached about the rod and slidable on the plate. Thus, the retainer bar is lockable against rotation when the free end is located in the locking aperture in the extension and in one of the holes to hold the brace means at a selected position and has the basin at a selected position.

Preferably, a limit means is provided for limiting an upward movement of the rod to an uppermost position. At this uppermost position, the free end of the rod is then disengaged from the holes in the plate as the rod is raised by the handle portion however the free end remains in the aperture in the extension of the retainer bar. With this limit means, it is thus easy to reinsert the free end of the rod into a selected aperture in the plate after movement of the retainer bar as desired.

In the preferred embodiment, the water connection means for the water supply means also serves as an automatic connector for the water return means. The water connection means thus includes a first inlet which is connectable to the pressurized water outlet as well as a first outlet which is fluidly connected to the first inlet and to which the first flexible supply hose is attached. In addition, the water connection means is provided with a second inlet to which the second flexible return hose is connected and a second outlet located opposite the first inlet which is fluidly connected to the second inlet. The water connection means also preferably includes a bypass means for selectively connecting the first inlet with the second outlet. Thus, flow from the pressurized water outlet can be directly connected to the second outlet in order to test the temperature of the water.

The portable salon unit of the present invention also preferably includes a spray head mounting means for mounting the spray head adjacent to the top of the cart when not in use. In addition, an adjustable light means adjacent to the top of the cart for providing light to an area adjacent the cart and the basin is provided. A tray holder is also preferably further provided located adjacent to the top of the cart for holding a blow dryer or the like. This tray holder includes an auxiliary electrical outlet which is connected to the first-mentioned electrical outlet on the cart.

It is an advantage of the present invention that salon quality services can be provided with the present invention at a number of different locations. One typical location is in a room of a patient in a hospital, retirement home or the like. In addition, the present invention can be used in a regular beauty and barber salon as a movable station to provide salon shampoo services IN a multi-use area.

It is also an advantage of the present invention that the portable salon unit can be used for such services as shampooing, cutting, perming, coloring, and styling hair as well as manicures, pedicures, facials, and skin care.

It is a further advantage of the present invention that the temperature of the water delivered to the basin by the water supply means can be tested for temperature. This testing can occur initially as well as at any subsequent time desired.

A still further advantage of the present invention is that it is tankless and thus does not require the use of water tanks, either for the clean water or the dirty water. Thus, the present invention is considerably lighter in use than those prior devices which required their own source of water which was carried in the various water tanks. In addition, the present invention does not experience any down time which would be required by systems with tanks to keep the tanks clean and sanitary. The present invention also has a virtually unlimited water supply when attached to a faucet or the like and thus there is no danger of running out of clean water at a crucial time as might occur were clean water only available from a self-contained tank. The problem of water temperature with tank systems, either creating with water with a desired temperature by a self-contained heater or maintaining hot water a tank, is also avoided with the present invention as the water temperature is easily adjusted and provided for at the source.

Other features and advantages of the present invention are stated in or apparent from a detailed description of a presently preferred embodiment of the invention found hereinbelow.

DETAILED DESCRIPTION OF THE PREFERRED EMBODIMENT

Figure 1:
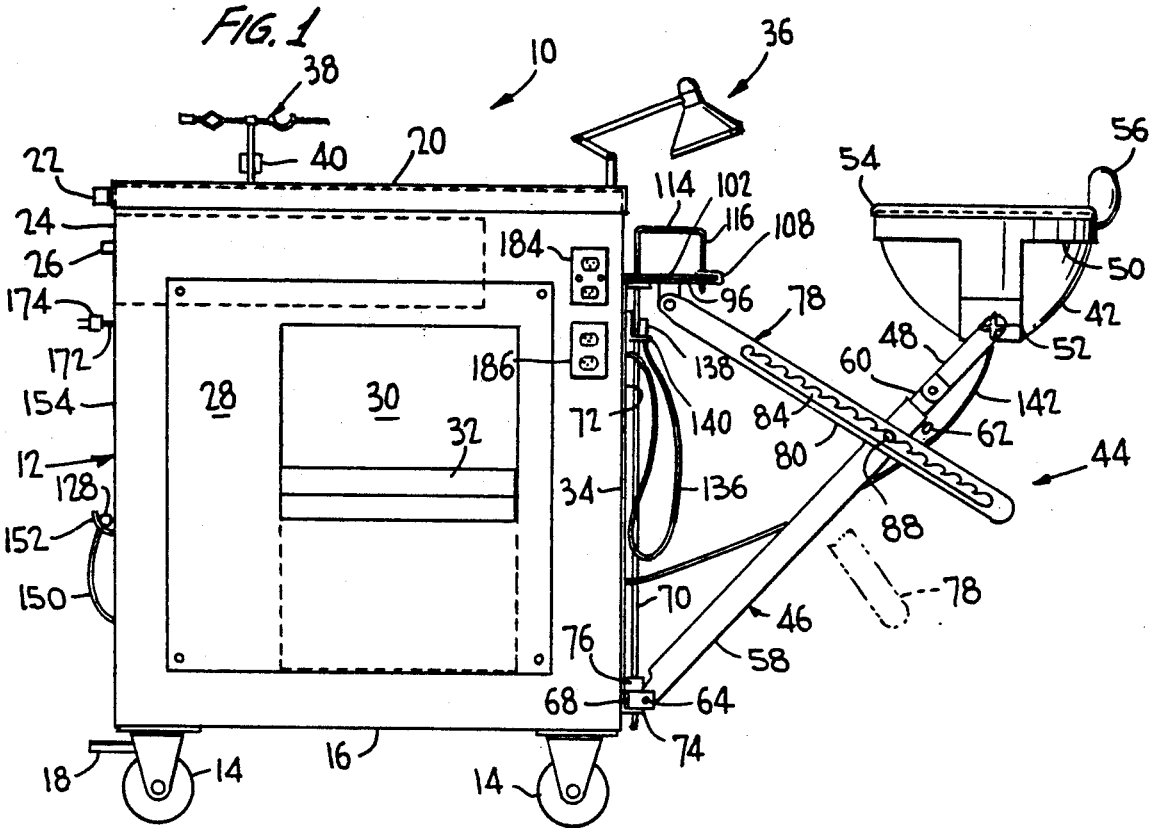
FIG. 1 is a front elevation view of a portable salon unit according to the present invention.
Figure 2:
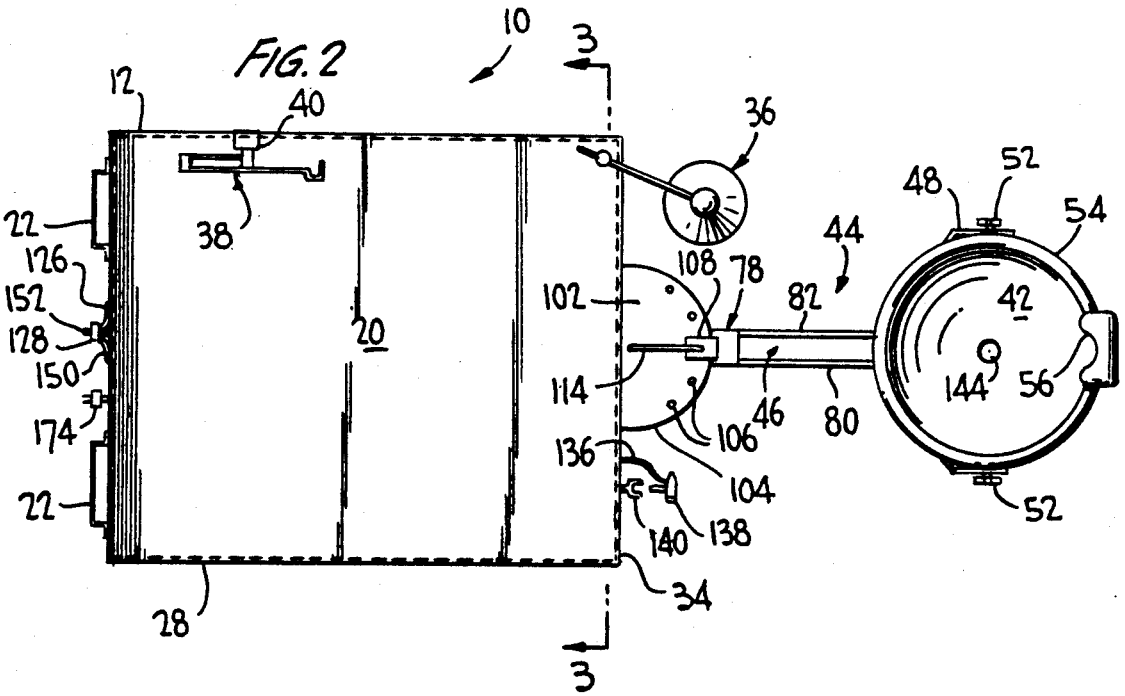
FIG. 2 is a top plan view of the portable salon unit depicted in FIG. 1.
Figure 3:
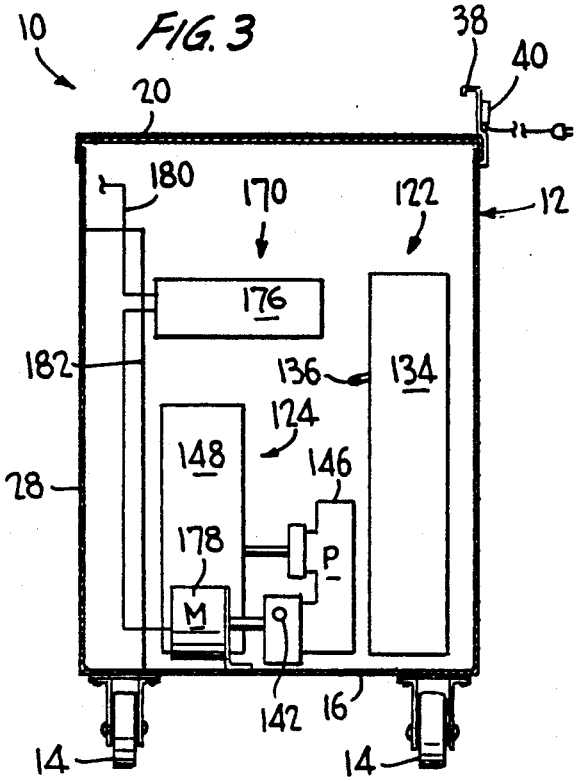
FIG. 3 is a cross-sectional side elevation view taken along the line 3—3 in FIG. 2.

With reference now the drawings in which like numerals represent like elements throughout the several views, a portable salon unit 10 according to the present invention is depicted in FIGS. 1, 2 and 3. As shoWn, portable salon unit 10 includes a cart 12 provided with pneumatic wheels 14 at a bottom 16 of cart 12. Preferably, at least each rear wheel 14 is swivel mounted and includes a locking lever 18 which is depressed to lock that rear wheel 14 against rotation and which is raised to the position depicted to allow rotation. A suitable cart for cart 12 is one which is MET (Medical Equipment Testing) approved and which is steam cleanable with all connections rust-proofed. Cart 12 is preferably made of steel and includes a top 20 to which handles 22 are attached for moving cart 12. A storage drawer 24 is also provided below top 20 and is opened by use of a handle 26. In a front 28, an opening 30 is provided for a waste basket 32 or the like.

Provided on top 20 adjacent one side 34 is a light means 36. Light means 36 is conveniently mounted on a post which is received in top 20, although light means 36 could be attached to top 20 by a suitable mounting bracket or the like. Also provided on top 20 is a tray holder 38 which is also suitably mounted by a bracket or the like. Tray holder 38 is conveniently a blow-wave styling station such as produced by Kayline Ent., Inc. of Long Beach, Calif. and is used for holding a blow dryer, a hair curler and the like. Tray holder 38 also includes an electrical outlet 40 which is suitably connectable to a source of electrical power provided on cart 12 (and discussed subsequently), as by a simple cord with a male plug.

Provided adjacent side 34 of cart 12 is a wash basin 42. Wash basin 42 is adjustably supported by a mounting means 44 which adjustably mounts wash basin 42 to cart 12. Mounting means 44 includes an upwardly extending brace means 46. At the upper end of brace means 46, a yoke 48 is provided to which a collar on seat 50 is suitably attached on either side by a bolt (not shown) extending through a respective arm of yoke 48 and a respective locking handle 52. Thus, by loosening locking handles 52, wash basin 42 can be adjusted to tilt about a horizontal axis passing through both locking handles 52. It should also be appreciated that wash basin 42 simply rests on the top of seat 50. Therefore, wash basin 42 is also rotatable in seat 50 about a vertical axis passing upwardly through wash basin 42 and seat 50. Provided around the top of wash basin 42 is a neoprene cushion 54 and a headrest 56 attached thereto. Instead of a headrest projecting above basin 42, basin 42 can include a depression in the rim serving as a headrest with a cushion at this area as well known to those in the art. With this latter configuration, the mounting seat would obviously have to be lower.

Upwardly extending brace means 46 is formed of a first brace 58 and a second brace 60 which is telescopically received in first brace 58. Then, a locking means 62 is provided which adjustably locks second brace 60 relative to first brace 58 at a desired position. Conveniently, locking means 62 is simply a spring operated pin which is pulled outwardly to allow adjustment of second brace 60 relative to first brace 58 and which is in receivable in a suitable one of a plurality of holes provided in second brace 60 to lock second brace 60 relative to first brace 58. With upwardly extending brace means 48, it should be appreciated that the height of wash basin 42 relative to side 34 of cart 12 is easily adjusted, while at the same time the distance of wash basin 42 from side 34 is also similarly adjusted somewhat.

Figure 5:
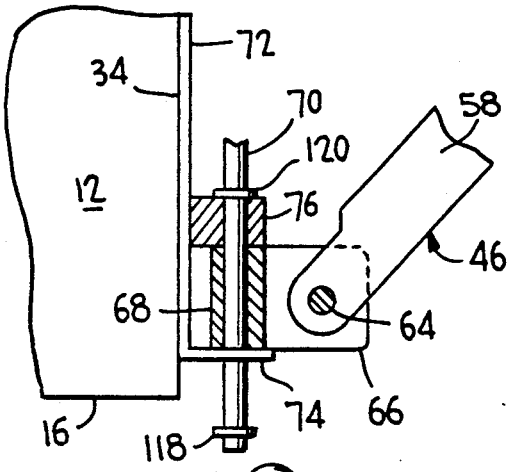
FIG. 5 is a front elevation view in partial cross-section of a lower portion of the mounting means depicted in FIG. 1.

As shown best in FIG. 5, first brace 58 is pivotally attached about an axle 64 provided between a pair of flanges 66 extending from a sleeve 68. Sleeve 68 is pivotally mounted about a rod 70 as shown. Rod 70 extends vertically adjacent side 34 and is maintained thereat by means of a bracket 72 attached to side 34. Extending from bracket 72 is a bottom flange 74 through which rod 70 passes and a holding flange 76 through which rod 70 also passes. Thus, it will be appreciated that sleeve 68 is trapped between holding flange 76 and bottom flange 74 although sleeve 68 is rotatable about rod 70, and that first brace 58 is rotatably mounted about axle 64.

As indicated above, upwardly extending brace means 46 is pivotally attached adjacent side 34 so that upwardly extending brace means 46 would fall downward if not for the presence of a downwardly extending brace means 78. Downwardly extending brace means 78 includes opposed sides 80 and 82 in-between which first brace 58 of upwardly extending brace means 46 extends. Opposed sides 80 and 82 are each formed with a longitudinal slot 84 having a series of teeth 86 extending therealong. Projecting on either side of first brace 58 is a pin 88 which is selectively engagable with one of teeth 86 and which otherwise can slide underneath of teeth 86 in longitudinal slot 84. Thus, it will be appreciated that the angular inclination of upwardly extending brace means 46 from side 34 of cart 12 is selectively adjustable by moving pin 88 along longitudinal slot 84 and then engaging each pin 88 with an appropriate tooth to hold upwardly extending brace means 46 at a selected position. The selected position of upwardly extending brace means 46 is designed to extend from a height about 8-12" above the floor on which cart 12 rests to a position above top 20 of cart 12. Between these extreme positions, it is anticipated that the feet, hands, and head of a user can be easily positioned in wash basin 42 regardless of whether the user is sitting, laying in bed, or otherwise positioned.

Figure 4:
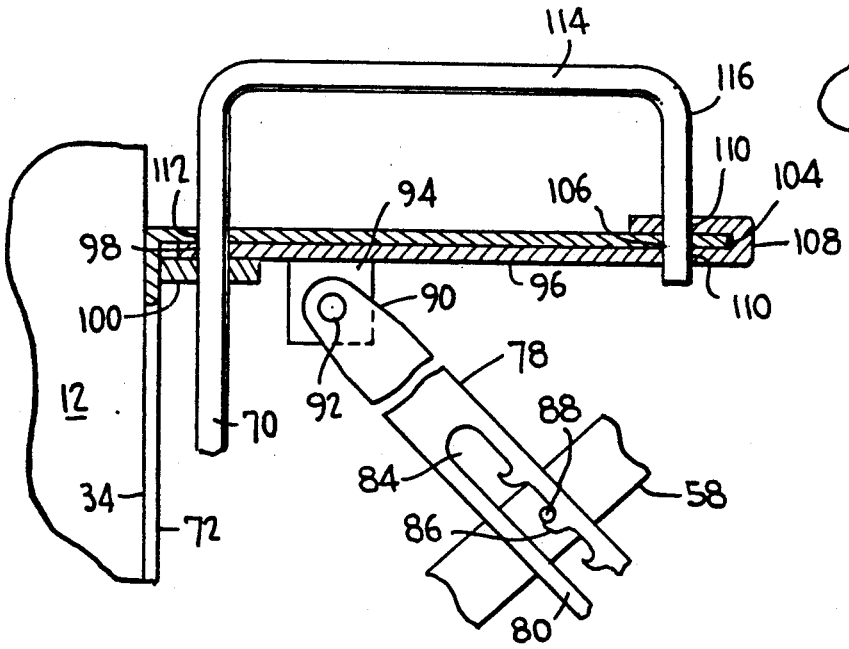
FIG. 4 is a front elevation view in partial cross-section of an upper portion of the mounting means.

As shown best in FIG. 4, a distal end 90 of downwardly extending brace means 78 is pivotally attached with an axle 92 to cart 12 adjacent side 34 for pivoting about a horizontal axis through axle 92. Axle 92 is mounted relative to cart 12 through a portion of mounting means 44 which also allows the angular position of wash basin 42 relative to cart 12 in a horizontal plane to be adjusted. Thus, axle 92 is provided through a mounting flange 94 which is attached to a retainer bar 96. As shown, retainer bar 96 includes a mounting aperture 98 at an end adjacent side 34 through which rod 70 extends. At this position, retainer bar 96 is maintained between a holding flange 100 which extends from bracket 72 and a plate 102 which extends from bracket 72 and is preferably integrally formed therewith. Plate 102 includes a rounded side 104 and a series of holes 106 spaced adjacent rounded side 104. Retainer bar 96 also includes an extension 108 which wraps around rounded side 104. Extension 108 includes an aperture 110 therethrough, which aperture 110 is spaced from rounded side 104 the same distance that holes 106 are spaced from rounded side 104.

Besides extending through holding flange 100 and mounting aperture 98 in retainer bar 96, rod 70 also extends upwardly through an aperture 112 in plate 102. Above plate 102, rod 70 includes a handle portion 114 extending over plate 102. Then, depending from handle portion 114 is a free end 116. As shown best in FIG. 4, free end 116 extends through aperture 110 and an extension 108 of retainer bar 96 in a selected one of holes 106 and plate 102. At the opposite end of rod 70, a limit means 118 is provided. Limit means 118 is conveniently simply a ring secured about rod 70. Thus, when rod 70 is raised by lifting handle portion 114, limit means 118 engages the bottom of bottom flange 74 to limit any further upward movement of rod 70.

It should be appreciated that limit means 118 is positioned at a distance from bottom flange 74 which is the same as the length of free end 116 located in and below plate 102. Thus, when rod 70 is raised by lifting handle portion 114, free end 116 is lifted out of hole 106 and plate 102 but is still retained in aperture 110 and extension 108. While rod 70 is lifted, retainer bar 96 is free to rotate about rod 70 adjacent side 34 and thus to similarly cause the rotation of wash basin 42 as downwardly extending brace means rotates with retainer bar 96 and thus pulls upwardly extending brace means 46 along with downwardly extending brace means 78. When wash basin 42 is located at a desired angular position about rod 70, handle portion 114 is released and free end 116 is pushed into one of holes 106 to lock retainer bar 96 and hence wash basin 42 in place. Holes 106 are provided over about 165° to allow wash basin 42 to be moved and locked over this angular limit. To limit the downward movement of handle portion 114, a ring 120 can be provided on rod 70 which engages holding flange 76.

Portable salon unit 10 also includes a tankless water supply means for supplying clean water to wash basin 42 and a tankless water return means 124 for returning so-called gray water from wash basin 42 to a suitable drain. Water supply means 122 includes a first flexible supply hose 126 which is connected at one end to a water connection means 128. Water connection means 128 is used for quickly and easily connecting first supply hose 126 to a suitable pressurized water outlet 130 such as a common faucet. In the preferred embodiment, water connection means 128 is a quick-connect element having a knob 132 which is reciprocated as water connection means 128 is mounted on pressurized water outlet 130. A suitable water connection means 128 is the type typically provided by SEARS for dishwashers and the like. Where such a coupling is used, it should also be appreciated that water outlet 130 must have a suitable adapter to receive water connection means 128. Of course, other water connection means 128 are possible, including a simple threaded-on fitting or the like. First supply hose 126 is suitable mounted in cart 12 by a supply reel means 134. Supply reel means 134 is typically a commercially available device which is spring-biased to automatically wind first supply hose thereabout but which can be held at various unwound positions (typically at each revolution of the associated reel) when it is desired to have first supply hose 126 withdrawn therefrom. Conveniently, supply reel means 134 contains approximately 30 feet of first supply hose 126 so that cart 12 can be conveniently located approximately 30 feet from a suitable water outlet 130. Supply reel means 134 also serves to connect first supply hose 126 to a second flexible supply hose 136. Second supply hose 136 leads from supply reel means 134 through side 34 of cart 12 to a spray head 138 provided with a suitable turnoff lever or the like. Second supply hose 136 has a sufficient length to allow spray head 138 to easily reach wash basin 42 regardless of the selected position of wash basin 42. For convenience, a spray head mounting means 140 in the form of a simple hook device is provided on side 34 for holding spray head 138 when not in use.

Water collected in wash basin 42 is drained therefrom through a first flexible return hose 142 connected to a drain 144 in wash basin 42. First return hose 142 leads to a pump means 146 located in cart 12. First return hose 142 also has a length sufficient to reach wash basin 42 in whatever position that wash basin 42 has been mounted. Pump means 146 automatically pumps water from first return hose 142 whenever water is located therein.

Pump means 146 is connected to a return reel means 148, which is also typically commercially available and similar to supply reel means 126. Mounted on return reel means 148 for winding and unwinding therefrom is a second flexible return hose 150. Second return hose 150 is fluidly connected to return reel means 148 and is about 30 feet in length, or at least has the same length as first supply hose 126. Conveniently, the distal end of second return hose 150 is also connected to water connection means 128. Thus, both first supply hose 126 and second return hose 128 are wound and unwound together from their respective reel means 134 and 148 as water connection means 128 is moved toward or away therefrom. A hook 152 is then provided adjacent side 154 of cart 12 on which water connection means 128 hangs when cart 12 is not in use.

Figure 6:
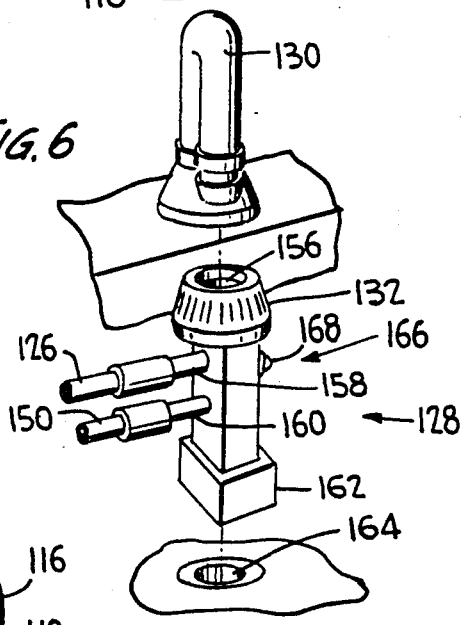
FIG. 6 is a schematic perspective view of a water connection means according to the present invention.

As shown in greater detail in FIG. 6, water connection means 128 includes a first inlet 156 located in knob 132 by which water from pressurized water outlet 130 enters water connection means 128. This water is normally directed by water connection means 128 to a first outlet 158 to which first supply hose 126 is connected. In addition, water connection means 128 includes a second inlet 160 to which second return hose 150 is connected. The water pumped by pump means 146 through second return hose 150 then exits water connection means 128 through a second outlet 162 and into a suitable drain 164 generally associated with pressurized water outlet 130.

It should also be appreciated that water connection means 128 also includes a bypass means 166. Bypass means 166 is used for selectively connecting first inlet 156 directly with second outlet 162, whereby flow from pressurized water outlet 130 proceeds directly through water connection means 128 bypassing both first supply hose 126 and second return hose 150. Bypass means 166 is actuated by a push button 168. Thus, it is possible to test the temperature of the water coming directly from pressurized water outlet 130 by depressing push button 168. It is thereby possible to adjust the water temperature as desired without the necessity of the water travelling over the entire length of water supply means 122 to determine the water temperature at spray head 138 after a long travel and associated lag time.

An electrical means 170 is also provided for portable salon unit 10. Electrical means 170 includes an electrical cord 172 having a male plug 174 at a distal end thereof. Provided in cart 12 is an electrical cord reel means 176 about which electrical cord 172 is wound and unwound. Electrical cord reel means 176 is also typically commercially available and similar in operation to supply reel means 134. Electrical cord 172 is preferably a 14 gauge hospital standard grounded cord having a standard length of 25 feet, whereby cart 12 can be located approximately 25 feet from a suitable electrical outlet to which electrical cord 172 can be attached. From cord reel means 176, electrical power is supplied to a motor 178 of pump means 146 by a wire 180 such that electrical power is supplied to motor 178 whenever male plug 174 is connected to a suitable source of electrical power. Another wire 182 connects cord reel means 176 to a hospital grade grounded outlet 184 containing an internal circuit breaker and test buttons. Also electrically connected with outlet 184 is a second outlet 186. It should be appreciated that electrical outlet 40 mounted on tray holder 38 is suitably connected to outlet 184 or 186 to supply power to electrical outlet 40.

In operation, portable salon unit 10 functions in the following manner. Initially, cart 12 is provided essentially in the form depicted in FIG. 1 so as to be readily moveable to a desired location. Typically, such a location is a patient's bed in a hospital. Thus, by means of wheels 14, cart 12 is easily transported to adjacent the patient's bed at which time locking levers 18 are depressed to hold cart 12 stationary. At this time, water connection means 128 is then connected to a suitable pressurized water outlet 130. This is easily accomplished by unwinding both first supply hose 126 and second return hose 150 from respective reel means 134 and 138 by pulling on water connection means 128. Both hoses 126 and 150 are unwound a sufficient distance and then the associated reel means 134 and 148 are locked in place to remove any tension on hoses 126 and 150. Water connection means 128 is then simply attached to pressurized water outlet 130 using a suitable coupling, such as a quick disconnect coupling accomplished by movement of knob 132.

After water connection means 128 is connected to pressurized water outlet 130, pressurized water outlet 130 is turned on and button 168 depressed in order to allow the water in pressurized water outlet 130 to flow directly through water connection means 128 and into drain 164. The operator then simply adjusts the temperature of the water in pressurized water outlet 130 to a desired temperature simply by feeling the water exiting water connection means 128. When the correct water temperature is achieved, button 168 is released.

After testing the water temperature, electrical cord 172 is unwound from cord reel means 176 a sufficient distance to allow male plug 174 to be inserted into an outlet within the reach of electrical cord 172. It should be appreciated that water connection means 128 is connected to pressurized water outlet 130 before electrical supply means 170 is connected to a suitable source of electrical power. If done in the reverse order, pump means 146 may automatically pump some residual water left in cart 12 and second return hose 150 through second return hose 150 which would then exit from second outlet 162 wherever water connection means 128 on cart 12 happened to be located. After achieving the desired water temperature, standing water in water supply means 122 should then be flushed therefrom by opening the lever on spray head 138 and flushing the water into wash basin 42.

Depending on whether the patient is to receive a shampoo, manicure, or pedicure, and the position of the patient, wash basin 42 is adjusted to a convenient location for the patient. Such adjustments include moving the cart to adjacent where the patient is, as well as raising or lowering the height of wash basin 42. The height of wash basin 42 is adjustable both by changing the length of upwardly extending brace means 46 as well as the location of pin 88 in selected teeth 86 of downwardly extending brace means 78.

It should be appreciated that the adjustment of downwardly extending brace means 78 relative to upwardly extending brace means 46 also adjusts the distance that wash basin 42 projects away from cart 12. This horizontal adjustment can be useful in positioning wash basin 42 over the side of a bed or other obstacle to conveniently reach the patient.

It should also be appreciated that the tilt of wash basin 42 about a horizontal axis passing through handles 52 is also selectively adjustable by loosening and tightening handles 52. In addition, the position of head rest 56 about a vertical axis through drain 144 is also adjustable by simply rotating wash basin 42 in seat 50 in which wash basin 42 rests.

Finally, the angular position of brace means 46 and 78 and hence wash basin 42 about rod 70 is also adjustable by lifting handle portion 114 of rod 70 until limit means 118 is engaged and thus free end 116 is withdrawn from aperture 106. Wash basin 42 is then simply moved rotationally to position free end 116 above a new hole 106. To lock wash basin 42 in this new position, handle portion 114 is simply dropped or depressed until free end 116 is positioned in new aperture 106 and ring 120 engages holding flange 76.

In use, spray head 138, light means 36, and tray holder 38 are used in their normal manner when shampooing, pedicuring, or manicuring. Then, when the operator is finished, the various elements of portable salon unit 10 are returned to the initial position to allow cart 12 to be again moved to a new desired location or to storage. It should be appreciated that before disconnecting water connection means 128 from pressurized water outlet 130, pressurized water outlet 130 is first turned off and the pressure built up is released by depressing button 168 of bypass means 166.

While portable salon unit 10 has been described with respect to an exemplary embodiment various changes and modifications would be possible. For example, upwardly extending brace means 46 could be a pneumatically actuated adjustable brace means rather than manually adjustable as described. A trailer pulled by a car for transporting portable salon unit 10 over roads can also be provided.

It would also be possible to provide water supply means 122 with an electric heater in case only a cold water tap were available. Further, first supply hose 126 and second return hose 150 would be coupled together (or even integrally formed) and wound about a single common reel which reel would then have suitable connections for each hose.

Thus, while the present invention has been described with respect to an exemplary embodiment thereof, it will be understood by those with ordinary skill in the art that variations and modifications can be effected within the scope and spirit of the invention.

I claim:

1. A portable salon unit comprising:

a movable cart having a top, sides, a bottom, and wheels below said bottom on which said cart is movable;

a wash basin located adjacent one side of said cart;

a mounting means for adjustably mounting said basin to said cart such that said basin is adjustable vertically and horizontally with respect to said one side of said cart, wherein said mounting means includes (a) an upwardly extending brace means for vertically supporting said basin which said basin is provided at a distal end thereof and which said upwardly extending brace means is pivotally attached at a proximal end thereof adjacent to said one side of said cart for rotation about a horizontal axis, said upwardly extending brace means including means for vertically adjusting said basin; (b) a downwardly extending brace means for holding said upwardly extending brace means at a desired inclination from said one side of said cart, said downwardly extending brace means being pivotally attached to said cart at a proximal end thereof adjacent said top of said cart for rotation about a horizontal axis; and (c) a locking means for releasably locking a portion of said upwardly extending brace means and said downwardly extending brace means whereby the height of said basin and the horizontal distance of said basin from said cart are adjustable;

a water supply means for supplying water to said basin; and a water return means for returning water from said basin to a drain.

2. A portable salon unit as claimed in claim 1 wherein said mounting means includes means for adjustably mounting said basin for adjustment about a horizontal axis through said basin and a vertical axis through said basin.

3. A portable salon unit as claimed in claim 1 wherein said basin further includes a head rest.

4. A portable salon unit as claimed in claim 1 wherein said mounting means further includes (a) a rod disposed vertically adjacent said one side of said cart and having a perpendicular handle portion and a free end depending from said handle portion; (b) a guide means for mounting said rod for vertical movement adjacent said one side of said cart with the handle portion uppermost;

(c) a plate having a rounded side extending horizontally from adjacent the top of said cart, said plate including a series of holes spaced adjacent said rounded side and an aperture through which said rod extends; and (d) a retainer bar mounted below said plate, said retainer bar including a mounting aperture through which said rod extends to rotatably mount said retainer bar thereabout, an extension which wraps around said rounded side of said plate to hold said retainer bar adjacent said plate, a locking aperture extending through said extension and an underlying portion of said retainer bar which selectively aligns with said holes of said plate and through which the free end of said rod is extendable to lock said retainer bar relative to said plate at a selected angular position about said rod; and wherein said upwardly extending brace means is pivotally attached about said rod; and said downwardly extending brace means is attached to said retainer bar which is pivotally attached about said rod and slidable on said plate, and which said retainer bar is thus lockable against rotation where said free end is located through said locking aperture in said extension and in one of said holes.

5. A portable salon unit as claimed in claim 4 and further including a limit means for limiting an upward movement of said rod to an uppermost position such that said free end is disengaged from said holes in said plate by raising said rod with said handle portion to the uppermost position but said free end remains in said aperture is said extension of said retainer bar.

6. A portable salon unit as claimed in claim 1 wherein said water connection means for said water supply means includes (a) a first inlet which is connectable to the pressurized water outlet, (b) a first outlet which is fluidly connected to said first inlet and to which said first flexible supply hose is attached, (c) a second inlet to which said second flexible return hose is connected, and (d) a second outlet located opposite said first inlet which is fluidly connected to said second inlet.

7. A portable salon unit as claimed in claim 6 wherein said water connection means further includes a bypass means for selectively connecting said first inlet with said second outlet whereby flow from the pressurized water outlet is directed to said second outlet.

8. A portable salon unit as claimed in claim 1 and further including a spray head mounting means for mounting said spray head adjacent said top of said cart when not in use.

9. A portable salon unit as claimed in claim 8 and further including an adjustable light means adjacent said top of said cart and connected to said electrical supply means for providing light to an area adjacent said cart and said basin.

10. A portable salon unit as claimed in claim 9 and further including a tray holder located adjacent said top of said cart for holding a blow dryer, and an auxiliary electrical outlet mounted on said tray holder which is connected to said electrical supply means.

11. A portable salon unit as claimed in claim 1 wherein said electrical supply means further includes an electrical cord having a male plug at a distal end thereof, an electrical outlet mounted to said cart and having a connection wire, and an electrical cord reel means provided in said cart for mounting electrical cord for winding and unwinding thereabout and for electrically connecting said electrical cord to said connection wire.

12. A portable salon unit as claimed in claim 1 wherein said means for vertically adjusting said basin comprises a first brace, a second brace telescopically received in said first brace, and a locking means for releasably locking said second brace relative to said first brace at selected positions.

13. A portable salon unit as claimed in claim 1 wherein said mounting means includes means for adjustably mounting said basin for rotation about a vertical axis.

14. A portable salon unit as claimed in claim 1 wherein said water supply means including a first flexible supply hose, a water connection means for connecting an end of said first supply hose to a pressurized water outlet, a spray head, a second flexible supply hose which is connected to said spray head, and a supply reel means provided in said cart for mounting said first supply hose for winding and unwinding thereabout and for fluidly connecting said first supply hose to said second supply hose.

15. A portable salon unit as claimed in claim 1 wherein said water return means including an electrical pump means located in said cart for pumping water, a first flexible return hose connecting said basin with said pump means, a second flexible return hose, and a return reel means provided in said crt for mounting said second return hose for winding and unwinding thereabout and for fluidly connecting said pump means with said second return hose.

16. A portable hose as claimed in claim 1 wherein said mounting means including means for adjustment of said basin about a vertical axis with respect to said cart and means for tiltable adjustment of said basin about a horizontal axis with respect to said cart.

17. A portable salon unit comprising:

a movable cart having a top, sides, a bottom, and wheels below said bottom on which said cart is movable;

a wash basin located adjacent one said side of said cart and having a head rest;

a mounting means for adjustably mounting said basin to said cart such that said basin is adjustable vertically with respect to said cart, horizontally with respect to said one side of said cart, rotatably about a vertical axis adjacent said one side of said cart, about a vertical axis through said basin, and a horizontal axis through said basin, said mounting means including: (a) an upwardly extending brace means for vertically supporting said basin which said basin is provided at a distal end thereof and which said upwardly extending brace means is pivotally attached at a proximal end thereof adjacent to the bottom and said one side of said cart for rotation about a horizontal axis, said upwardly extending brace means including a first brace, a second brace telescopically received in said first brace, and a first locking means for releasably locking said second brace relative to said first brace at selected positions; (b) a downwardly extending brace means for holding said upwardly extending brace means at a desired inclination from said one side of said cart, said downwardly extending brace means being pivotally attached to said cart at a proximal end thereof adjacent said top of said cart for rotation about a horizontal axis; (c) a second locking means for releasably locking a portion of one of said first brace means and said second brace means along a length of the other of said first brace means and second brace means whereby the height of said basin and the horizontal distance of said basin from said cart are adjustable; (d) a rod disposed vertically adjacent said one side of said cart and having a perpendicular handle portion and a free end depending from said handle portion; (e) a guide means for mounting said rod for vertical movement adjacent said one side of said cart with the handle portion uppermost; (f) a plate having a rounded side extending horizontally from adjacent the top of said cart, said plate including a series of holes spaced adjacent said rounded side and an aperture through which said rod extends; (g) a retainer bar mounted below said plate, said retainer bar including a mounting aperture through which said rod extends to rotatably mount said retainer bar thereabout, an extension which wraps around said rounded side of said plate to hold said retainer bar adjacent said plate, a locking aperture extending through said extension and an underlying portion of said retainer bar which selectively aligns with said holes of said plate and through which the free end of said rod is extendable to lock said retainer bar relative to said plate at a selected angular position about said rod; (h) a limit means for limiting an upward movement of said rod to an uppermost position such that said free end in disengaged from said holes in said plate by raising said rod with said handle portion to the uppermost position but said free end remains in said aperture is said extension of said retainer bar; and wherein said upwardly extending brace means is pivotally attached about said rod and said downwardly extending brace means is attached to said retainer bar which is pivotally attached about said rod and slidable on said plate, and which said retainer bar is thus lockable against rotation where said free end is located through said locking aperture in said extension and in one of said holes;

a water supply means for supplying clean water from a pressurized water outlet to an object located in said basin, said water supply means including a first flexible supply hose which is connected at an end to the pressurized water outlet, a spray head, a second flexible supply hose which is connected to said spray head, and a supply reel means provided in said cart for mounting said first supply hose for winding and unwinding thereabout and for fluidly connecting said first supply hose to said second supply hose;

a water return means for returning water from said basin to a drain, said water return means including a pump means located in said cart for pumping water, a first flexible return hose connecting said basin with said pump means, a second flexible return hose, and a return reel means provided in said cart for mounting said second return hose for winding and winding thereabout and for fluidly connecting said pump means with said second return hose;

a water connection means for connecting said first supply line to the pressurized water outlet and for connecting said second return hose to the drain which is located adjacent said pressurized water outlet, said water connection means including (a) a first inlet which is connectable to the pressurized water outlet, (b) a first outlet which is fluidly connected to said first inlet and to which said first flexible supply hose is attached, (c) a second inlet to which said second flexible return hose is connected, (d) a second outlet located opposite said first inlet which is fluidly connected to said second inlet, and (e) a bypass means for selectively connecting said first inlet with said second outlet whereby flow from the pressurized water outlet is directed to said second outlet; and an electrical supply means for supplying electrical power to said cart, said electrical supply means including an electrical cord having a male plug at a distal end thereof, an electrical outlet mounted to said cart and having a connection wire, and an electrical cord reel means provided in said cart for mounting electrical cord for winding and unwinding thereabout and for electrically connecting said electrical cord to said connection wire.

18. A portable salon system comprising:

a wash basin;

a mounting means for adjustably mounting said wash basin to a base for adjustment vertically with respect to the base and horizontally with respect to the base;

a water supply means for supplying clean water directly to said basin from a remotely located source of pressurized clean water, said water supply means including a flexible supply hose, a water connection means for connecting an end of said flexible supply hose to a water outlet of the source of pressurized clean water, a spray head which has fluidly connected to said flexible supply hose, and a supply winding means about which said flexible supply hose is wound and unwound;

said water connection means including a first outlet to which said flexible supply hose is connected and to which the water is normally directed and a second outlet which is normally closed, and a bypass means for bypassing said first outlet and hence said flexible supply hose whereby water passes directly from said source to said second outlet; and a water return means for returning water from said basin immediately and directly to a remotely located drain, said water return means including a pump means for pumping the water from said basin directly to the drain.

19. A portable salon system as claimed in claim 18 wherein said water return means includes a flexible return hose fluidly connected between said pump means and a suitable drain, and a return winding means about which said flexible return hose is wound and unwound.

20. A portable salon system as claimed in claim 19 wherein said pump means includes an electrical pump and further including an electrical supply means for supplying electrical power to said pump, said electrical supply means including an electric cord, an electric winding means about which said electrical cord is wound and unwound, and an electrical outlet.

21. A portable salon system as claimed in claim 20 and further including a wheeled base to which said mounting means, said water supply means, said water return means, and said electrical supply means are mounted.

* * * * *